United States Patent [19]

Lockard et al.

[11] Patent Number: 4,840,390

[45] Date of Patent: Jun. 20, 1989

[54] SYMMETRICALLY MODULAR WHEELCHAIR

[75] Inventors: Walter G. Lockard; Allen J. Boris, both of Elyria; Wieslaw Kosc, North Royalton, all of Ohio

[73] Assignee: Invacare Corporation, Elyria, Ohio

[21] Appl. No.: 913,501

[22] Filed: Sep. 30, 1986

[51] Int. Cl.[4] ..... A61G 5/02

[52] U.S. Cl. ..... 280/250.1; 280/42; 280/304.1; 297/416; 297/429; 297/DIG. 4

[58] Field of Search ..... 280/657, 650, 42, 289 WC, 280/242 WC; 297/DIG. 4, 45, 416, 417, 429, 436

[56] References Cited

U.S. PATENT DOCUMENTS

| | | | |
|---|---|---|---|
| 2,354,949 | 8/1944 | Ducavich | 297/DIG. 4 |
| 2,914,111 | 11/1959 | Mize | 297/DIG. 4 |
| 3,453,027 | 7/1969 | Pivacek | 297/429 |
| 3,814,477 | 6/1974 | Mattsson | 297/DIG. 4 |
| 3,854,774 | 12/1974 | Limpach | 297/429 |
| 3,883,175 | 5/1975 | Rodaway | 297/417 |
| 4,241,932 | 12/1980 | Hartmann | 280/289 WC |
| 4,358,125 | 11/1982 | Charles | 280/242 WC |
| 4,457,535 | 7/1984 | Takeuchi et al. | 280/650 |
| 4,484,780 | 11/1984 | Thompson | 297/433 |
| 4,486,048 | 12/1984 | Meyer | 297/433 |
| 4,493,488 | 1/1985 | Panaia et al. | 280/42 |
| 4,500,109 | 2/1985 | Volin | 280/289 WC |
| 4,515,383 | 5/1985 | Minnebraker | 280/42 |
| 4,582,448 | 4/1986 | Costello et al. | 280/242 WC |
| 4,676,519 | 6/1987 | Meier | 280/242 WC |

FOREIGN PATENT DOCUMENTS

| | | | |
|---|---|---|---|
| 2326912 | 5/1977 | France | 280/42 |
| 593384 | 10/1947 | United Kingdom | 280/42 |
| 672174 | 5/1952 | United Kingdom | 280/42 |

OTHER PUBLICATIONS

Advertising brochure of Invacare, Inc. for "ROLLS Compact Rollite", 1983.

Advertising brochure of Invacare, Inc. for "ROLLS 500 ATS", 1985.

Advertising brochure of Active Life, Inc. for "A.L. Wheelchairs", Aug. 1985.

Advertising brochure of Everest and Jennings for "ULTRALIGHT PREMIER", Jan. 1985.

Advertising brochure of Motion Designs, Inc. for "QUICKIE", Brand wheelchairs, Dec. 1984.

*Primary Examiner*—David M. Mitchell

*Attorney, Agent, or Firm*—Fay, Sharpe, Beall, Fagan, Minnich & McKee

[57] ABSTRACT

A pair of identical side frames (A) are each made up of a pair of generally L-shaped tubular members which are welded together. A reinforcing tube (30) is slidably received within a forward portion (14) of each side frame to strengthen an interconnection with a front wheel assembly mounting bracket (32) with mechanical fasteners. A swing away leg rest mounting bracket (50) is also connected with the forward tubular portion and reinforcing tube for selectively supporting a swing away leg rest assembly thereon. A folding mechanism (D) includes a pair of pivotally connected seat support structures (100). The seat support structures include seat side supports (102) which have a longer free end (106) and shorter free end (108), cross mambers 104 and fittings (120). Circumferentially disposed grooves (124) are offset in such a manner that the seat support structures are interchangeable. An arm rest assembly (F) is releasably connected with the side frames with brackets (162, 174) such that the arm support structure can be selectively removed form the brackets or pivoted about one of them.

16 Claims, 8 Drawing Sheets

SYMMETRICALLY MODULAR WHEELCHAIR

BACKGROUND OF THE INVENTION

The present invention relates to vehicles, particularly vehicles for use by the mobility impaired. The invention finds particular application in conjunction with light weight, foldable wheelchairs which are readily transported to a site of use. Such chairs are frequently used by the elderly and others who have limited mobility, but lack the endurance for shopping centers and other activities. Although described in conjunction with light weight wheelchairs, it will be appreciated that the invention will find utility with other wheelchairs and vehicles.

Heretofore, wheelchairs have had a large number of left handed and right handed parts. That is, parts designed for the left side of the wheelchair could not be interchanged with parts from the right side of the wheelchair or vice versa. This lack of interchangeability increased manufacturing complexity and inventory. Moreover, separate inventories were necessary for aftermarket replacement parts for the left and right hand sides of the wheelchairs.

Most non-prescription wheelchairs have a very limited number of options. Rather, non-prescription chairs have numerous weld joints which permanently affix the various components and subassemblies. Such chairs are not readily amenable to varying the features. Instead, such chairs are normally designed to fall in different price ranges, each range having preselected features.

The present invention provides a wheelchair that has numerous modules and components that can be readily added or deleted and which may be utilized on either side of the chair.

SUMMARY OF THE INVENTION

In accordance with one aspect of the present invention, a wheelchair is provided in which the left and right side frames are identical and interchangeable. Each side frame includes first and second bent, generally L-shaped tubing sections. Front and rear wheel assemblies are mounted to the respective side frames.

In accordance with another aspect of the present invention, the side frames each have a generally vertical forward tubular portion in which a reinforcing tube is slidably received. Front wheel assemblies are attached to the forward tubular side frame portions by mechanical fasteners which extend through front wheel assembly mounting brackets, the forward tubular portion, and the reinforcing tube to mount the wheel assemblies to the side frames.

In accordance with another aspect of the present invention, mechanical fasteners are utilized to interconnect a pair of front leg rest mounting members to forward tubular side frame portions in which reinforcing tubes are slidably received.

In accordance with another aspect of the present invention, a wheelchair is provided that has selectively removable, swing-away arm rest assemblies. Each arm rest assembly includes first and second mounting brackets connected to the wheelchair side frames. An arm support portion is releasably supported by the first and second mounting brackets. Releasing the arm support portion from both the first and the second brackets enables the arm support portion to be removed. The first mounting bracket is pivotally connected to the side frame such that by releasing the side arm from the second mounting bracket only, the side arm assembly may be pivoted.

In accordance with another aspect of the present invention, a cross brace folding mechanism is provided for folding the wheelchair side frames together. The cross brace includes a pair of cross brace members which are each connected at an upper end with the seat and at a lower end with a horizontal portion of the side frame. Each cross brace member has a fitting on the lower end that defines a side frame receiving passage such that the fitting rotates on the horizontal side frame portion. A circumferentially extending groove and a mating projection maintain accurate positioning between the fitting and the horizontal side frame.

In accordance with another aspect of the present invention, a foldable wheelchair is provided in which the folding mechanism includes a pair of identical seat support structures which are interchangeable. Each structure includes a seat side support which is fixedly interconnected with a cross brace member. The upper end of each cross brace member is connected offset from the center of the seat side support such that the side support has a longer free end and a shorter free end. The cross brace members are pivotally interconnected such that one of the seat side supports is disposed with the side support longer free end forward and the other is mounted with the shorter free end forward. The relative lengths of the longer and shorter free ends are selected relative to the diameter of the cross brace members and relative to the size of the pivotal interconnection such that the front ends of the longer and shorter side support free ends are even.

In accordance with a more limited aspect of the invention, fittings mounted to the lower end of the cross brace members, wrap around a horizontal portion of the side frame. Pivotal links extend from the cross brace members and are pivotally connected to an upper portion of the side frame. The fittings and the pivotal links are held in alignment with circumferential groove and projection arrangements, which arrangements are disposed in the same position on both the left and right side frames and symmetrically on the seat support assemblies such that the seat support structures are reversable.

One advantage of the present invention is that it reduces replacement part and manufacturing inventories.

Another advantage of the present invention is that it facilitates customizing non-prescription wheelchairs and the selective addition of features and options.

Another advantage of the present invention is that it improves the manufacturing economy. Many features are included in this chair which heretofore have been available only on more expensive chairs.

Further advantages of the present invention reside in its modular construction and use of modules and components which are mountable on either the left or right hand side of the chair.

Still further advantages of the present invention will become apparent to those of ordinary skill in the art upon reading and understanding the following detailed description of the preferred embodiments.

BRIEF DESCRIPTION OF THE DRAWINGS

The invention may take form in various parts and arrangements of parts. The drawings are only for purposes of illustrating a preferred embodiment and are not to be construed as limiting the invention.

DETAILED DESCRIPTION OF THE PREFERRED EMBODIMENTS

Figure 1:
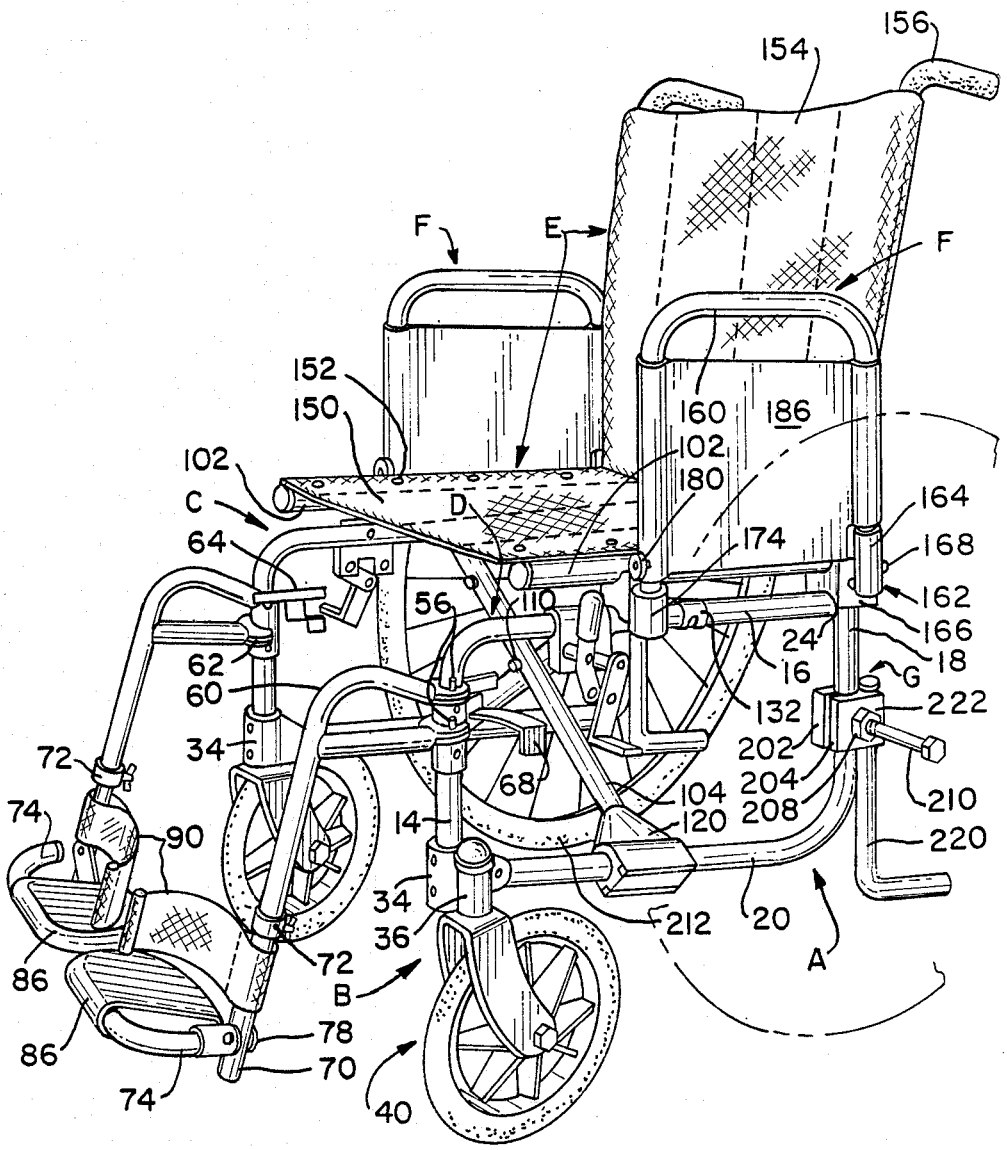
FIG. 1 is a perspective view of a wheelchair in accordance with the present invention with the near side rear wheel in phantom.

With reference to FIG. 1, the wheelchair includes a pair of identical side frames A. Front wheel assemblies B and leg support assemblies C are connected to a forward portion of the side frames. A folding mechanism D selectively enables the side frames to be moved together for more compact storage and easier handling. A seat E supports the operator. Selectively removable arm rest assemblies F are pivotally connected to the side frames to enable the arm support to be either pivoted relative to the frame or completely removed. A rear wheel and curb step mounting assembly G selectively mounts rear wheels to the side frame and reinforces their interconnection.

Figure 2:
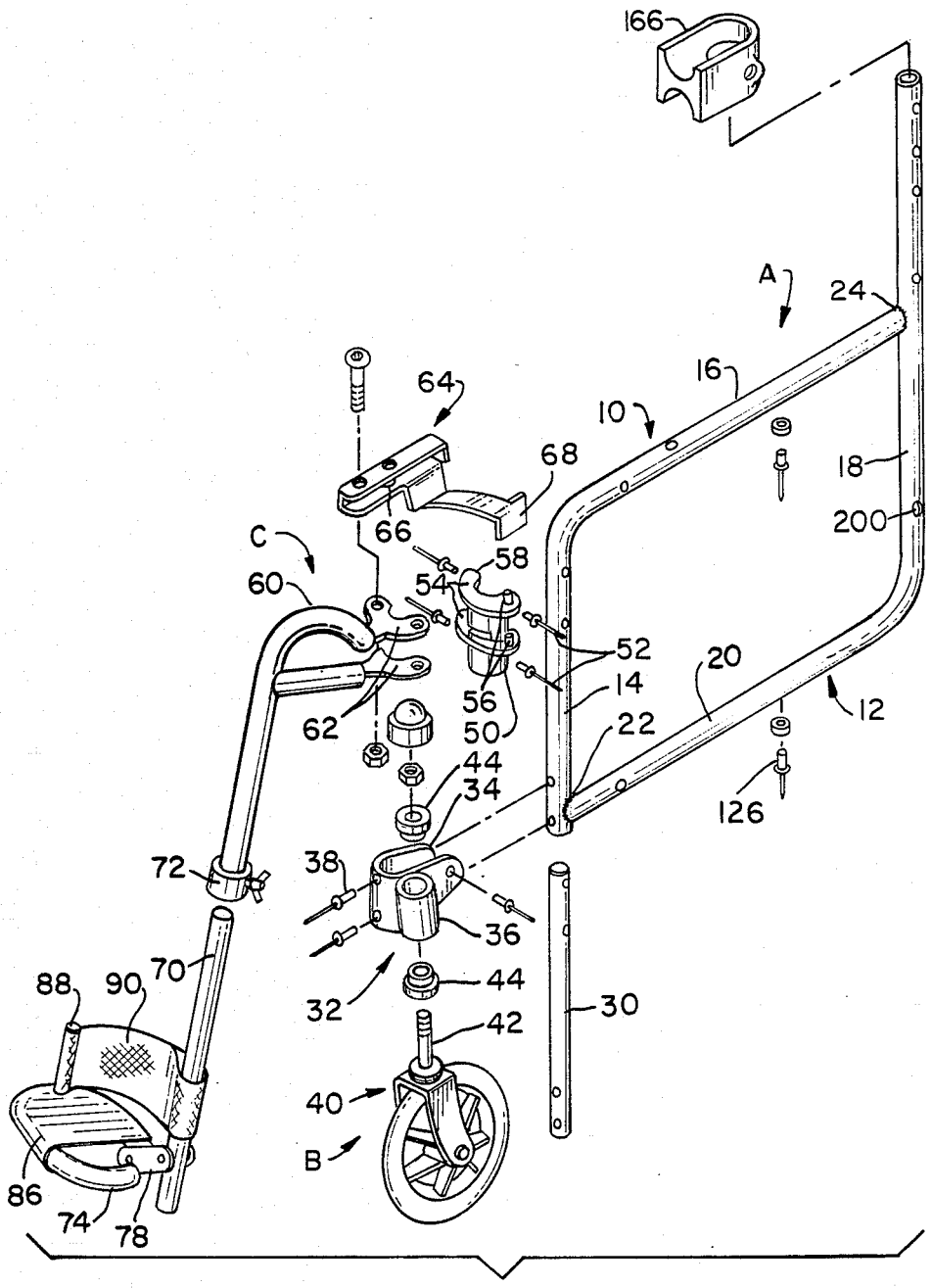
FIG. 2 is an exploded view illustrating a wheelchair side frame and the mounting arrangement for a front leg rest and front wheel assembly.

With particular reference to FIG. 2, the side frames A are each constructed of relatively thin walled, light weight tubing, such as aluminum, magnesium, titanium, and their alloys. Thin walled steel tubing is also contemplated. Because the left and right side frames are identical, to simplify inventory demands, only one of the side frames will be described in detail and it is to be appreciated that the description applies equally to both. The side frame consists of only a first generally L-shaped tubing section 10 and a second generally L-shaped tubing section 12. The first L-shaped tubing section includes a first or forward generally vertically disposed tubular portion or forward leg 14 which is intergrally connected by a bend with a first or upper generally horizontally disposed tubular portion or leg 16. The second L-shaped tubing section includes a second or rearward generally vertically disposed tubular portion or leg 18 and a second or lower generally horizontally disposed tubular portion or leg 20. The L-shaped tubing sections are welded at a forward lower interconnection 22 and a rearward upper interconnection 24. The forward, lower weld junction is reinforced by the front wheel mounting assembly B and the rearward upper weld joint is reinforced by the arm support assemblies F. This reinforcing of the welds with other assemblies facilitates the use of lighter weight tubing without sacrificing the reliability and durability of tubing junctions. In the preferred embodiment, the second, rearward vertical tubular portion extends upward beyond the upper rearward weld 24 to mount a portion of the seat E thereon. Optionally, a separate tubing portion may be interconnected to the side frame by a hinge or the like to support the upper seat portion.

The front wheel assemblies B are each connected with a corresponding one of the side frames A. A reinforcing tube 30 is slidably received in the front, vertical side frame tubing portion 14 to provide greater structural strength. A front wheel mounting bracket 32 is mounted to the side frame adjacent the forward, lower weld 22 to mount front wheel casters and to reinforce the weld. More specifically, the front wheel assembly mount includes a generally U-shaped bracket 34 to which a tubular portion 36 is welded. The bracket 34 and the tubular portion 36 are configured and interconnected to be symmetric about a horizontal axis such that the mount can be rotated top for bottom and used on the opposite side of the chair. Mechanical fasteners 38 extend through corresponding bores in the U-shaped bracket 34, the side frame forward, vertical tubular frame portion 14 and the lower horizontal frame portion 20, and the reinforcing tube 30. The mechanical fasteners may be bolts, pop-rivets or the like. A front wheel caster 40 has an upstanding post 42 which is mounted by appropriate bearings and other mounting means 44 to the front wheel mounting assembly bracket tube 36. Due to the symmetry of the mount, the stud 42 and the bearings and other mounting structures 44 may be inserted into the tubular portion 36 from either direction to enable the same parts to be used as either a right or left front wheel assembly.

With continuing reference to FIG. 2, the front leg support assembly C includes a mounting bracket 50 which is interconnected by mechanical fasteners 52 with corresponding apertures in the front generally vertical tubular frame portion 14 and the reinforcing tube 30. Each leg rest mounting bracket includes a pair of cams 54 which have pivot pins 56 at one end and locking surfaces 58 at their other ends. Optionally, the pivot pins 56 may extend symmetrically through the cam surfaces to enable the bracket 50 to be inverted top to bottom for placement on the opposite side of the frame.

An upper leg support mounting member 60 has a pair of hinge plates 62 that have apertures for receiving the pins 56 of the mounting bracket 50. A spring biased cam follower assembly 64 is pivotally mounted to one of the hinge plates such that a spring biases a follower portion 66 thereof against the corresponding one of cams 54. The cam follower portion 66 is spring biased to lock behind the locking surfaces 58 when the leg support member is facing straightforward. By pressing a manual, release lever 68, the cam follower 66 is biased against the spring out of contact with the stop surfaces 58 to allow the leg assembly to pivot on pivot pins 56. The hinge members 62 may be asymmetric to limit their mounting to the left or right side of the chair to prevent the leg rest assemblies from being mounted backwards. Optionally, the hinge members may be symmetric about a central axis and define pivot holes on either side thereof. The symmetric positioning of holes for the cam follower enables the leg rest to be mounted on either side of the chair.

Figure 3:
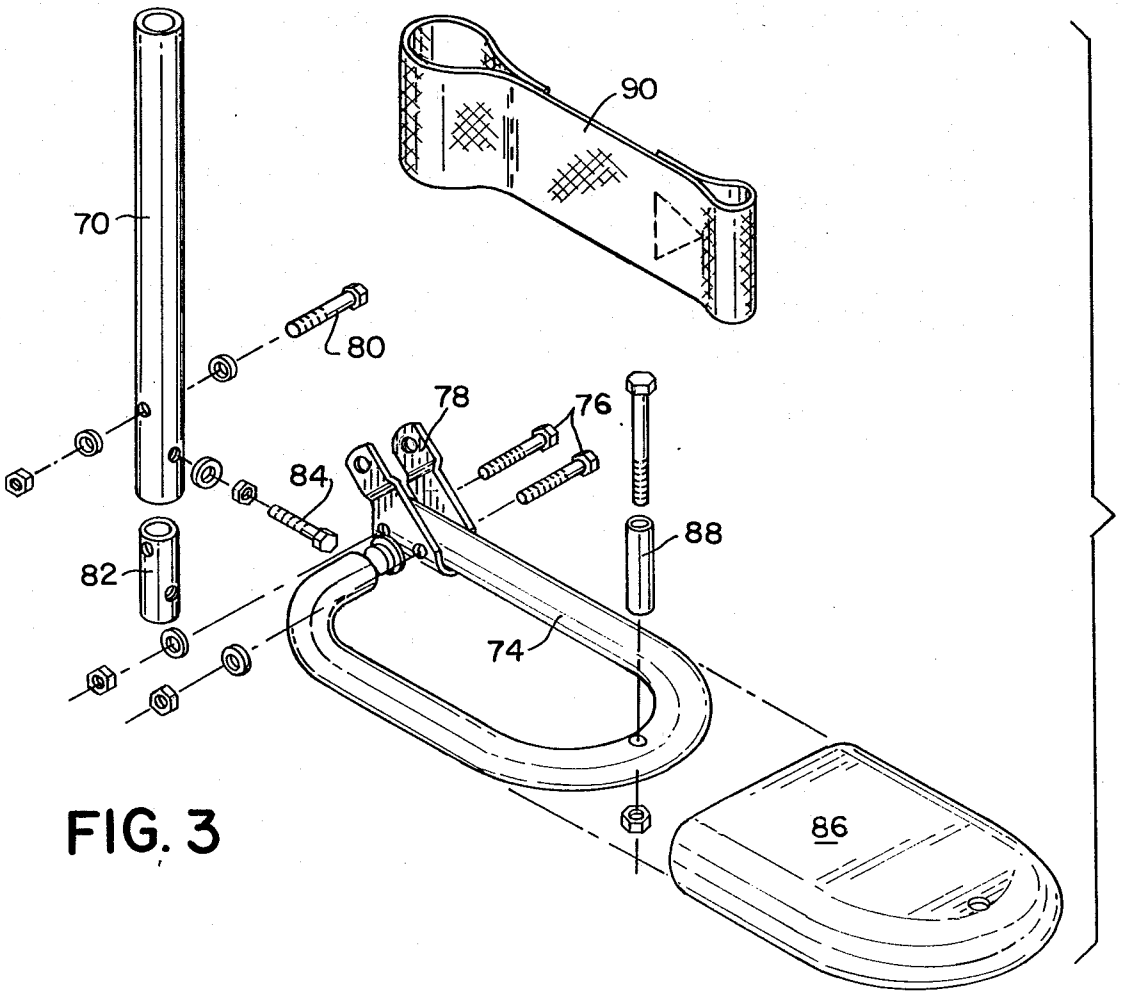
FIG. 3 is an exploded view illustrating the front foot support assembly.

With continuing reference to FIG. 2 and further reference to FIG. 3, a foot support extension tube 70 is telescopically received in portion 60 with a degree of telescopic receipt set by a clamping means 72. A generally U-shaped foot rest member 74 is connected by mechanical fasteners 76 to a mounting bracket 78. The generally U-shaped member 74 and the mounting bracket 78 are the same for both left and right side foot rests, but their interconnection is reversed by 180°. Another mechanical fasteners 80 pivotally interconnects the bracket 78 with the extension tube 70. A solid plug 82 provides increased structural strength to the lower end of tube 70. An adjustable stop, such as a bolt 84 is tapped into the plug 82 and abuts the bracket 78. By adjusting the distance with which the stop 84 extends from the plug 82, the rest position of the foot rest is selectively adjustable.

Figure 4:
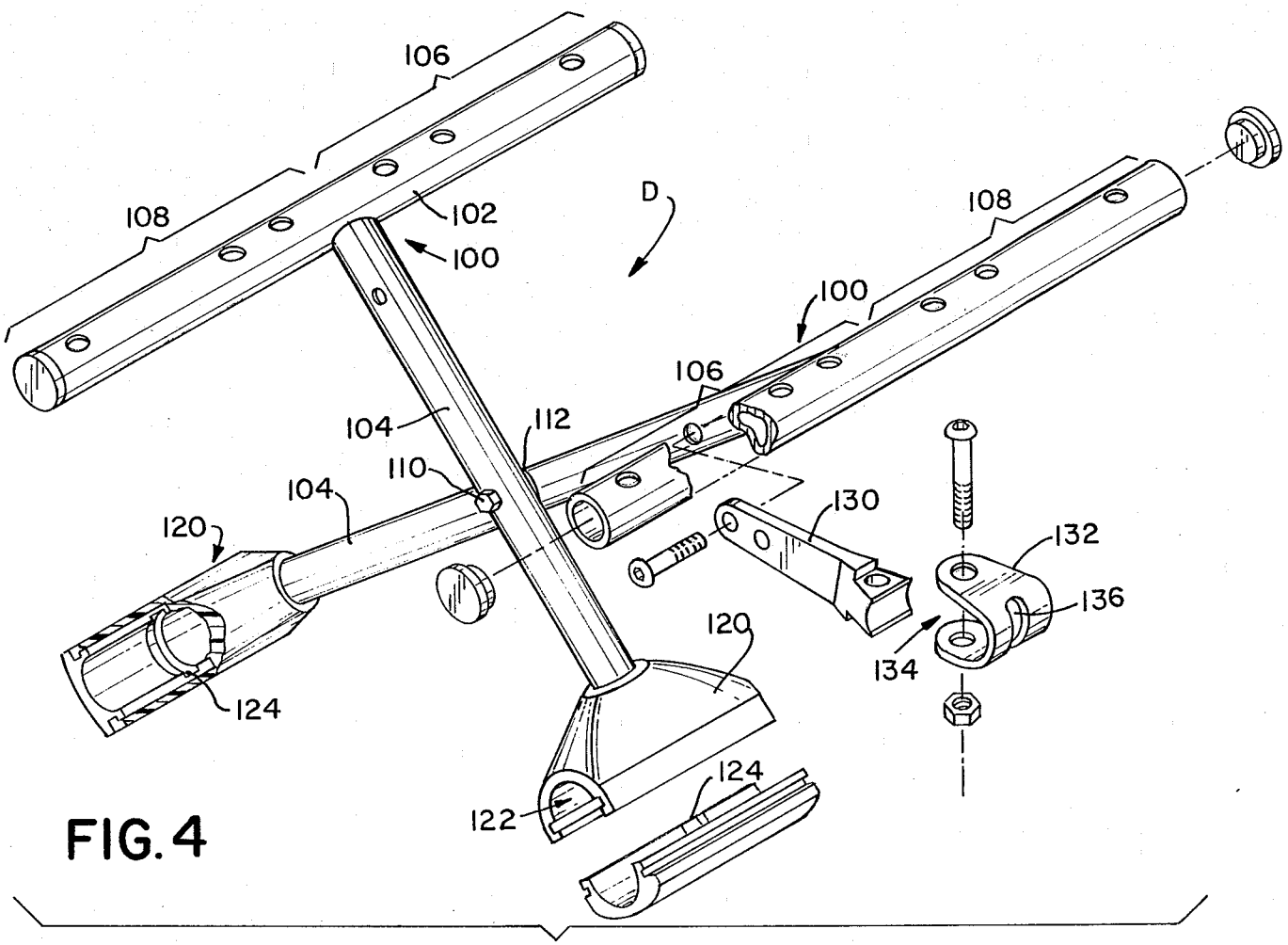
FIG. 4 is a perspective view illustrating the folding mechanism of the wheelchair.
Figures 5, 6:
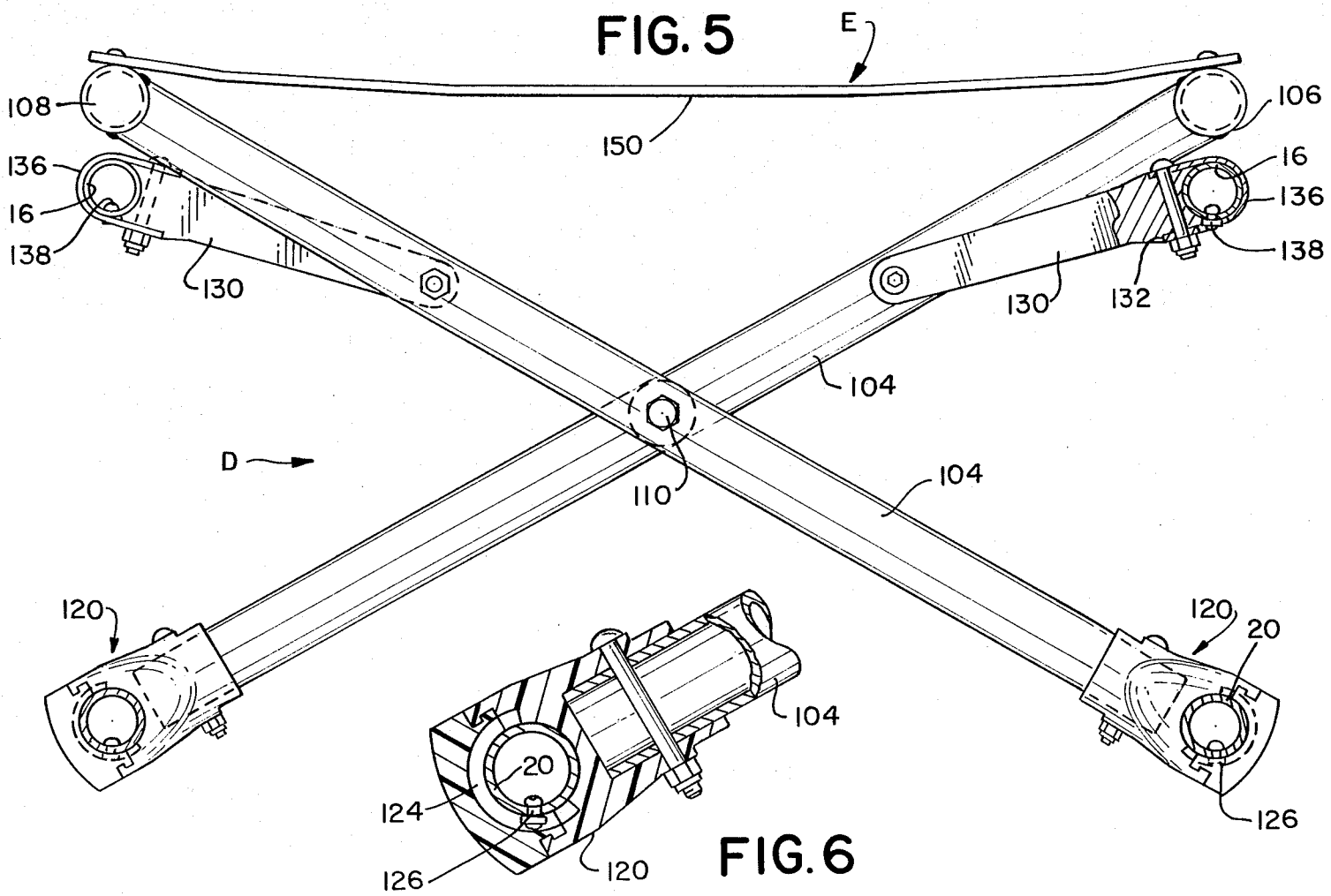
FIG. 5 is a front view of the folding mechanism.
FIG. 6 is a sectional view through one of the fittings at the lower end of the folding mechanism.

A molded plastic foot rest cover 86 slides over the U-shaped tube 74 and is anchored thereto by a post 88. A foot support strap 90 is telescopically received over the extension tube 70 and the post 88. The post 88 is mounted symmetrically in the U-shaped portion 74 such that the foot rest cover 86 may be utilized with either the left or right side. With continuing reference to FIG. 1 and further to FIGS. 4 and 5, the folding mechanism D is interconnected with the side frames A and the seat E. The folding mechanism includes two identical generally T-shaped seat support structures 100. Each seat support structure includes a seat support member 102 which is connected with a cross brace member 104. The cross brace member is interconnected with the seat support member 104 offset from its center such that the seat side support member 102 defines a longer free end 106 and a shorter free end 108. The cross brace members are interconnected by a pivot joint 110 which may include a nylon spacer or the like 112 between the cross members. The relative lengths of the longer and shorter free ends are selected relative to the diameter of the cross brace members and the thickness of any washer 112 such that the forward most ends of the seat support member are parallel and the rearward most ends of the seat support members are parallel.

A fitting 120 is interconnected with the lower end of each cross member for rotatable interconnection with the lower horizontal side frame tubular portion 20. More specifically, the fitting 120 defines a side frame receiving passage 122 extending longitudinally therefore for rotatably receiving the tubular side frame portion. To maintain the horizontal side frame portion and the folding mechanism in proper alignment, the fitting defines a groove 124 extending circumferentially. A projection 126, such as a pop rivet mounted to the side frame, is slidably received in the circumferentially extending groove. The groove is offset in the same direction as the longer free end 106 of the seat support structure such that it is substantially in alignment with the center of the washer 112 of the pivot means. This places the circumferential grooves of the pivotally interconnected seat support structures in alignment across the chair. Both side frames have an aperture bored in the same place the same distance from the front of the frame to receive the mechanical fastener 126. In this manner, the reversibility of the side frames is assured.

An alignment link 130 is pivotally connected at one end with the cross member 104 and has a fitting or connection 132 at its other end which defines an upper generally horizontal extending frame side tube passage 134. The fitting 132 defines a circumferentially extending groove or slot 136 which receives a projection 138 projecting from the upper, horizontally extending tubular side frame portion 16. The circumferentially extending groove or slot 136 is again aligned with the center of the pivot washer 112 such that bores or apertures for the projections 138 are in the same location on both left and right side frames. This enables the side frames to be interchanged without boring additional apertures.

Figure 7:
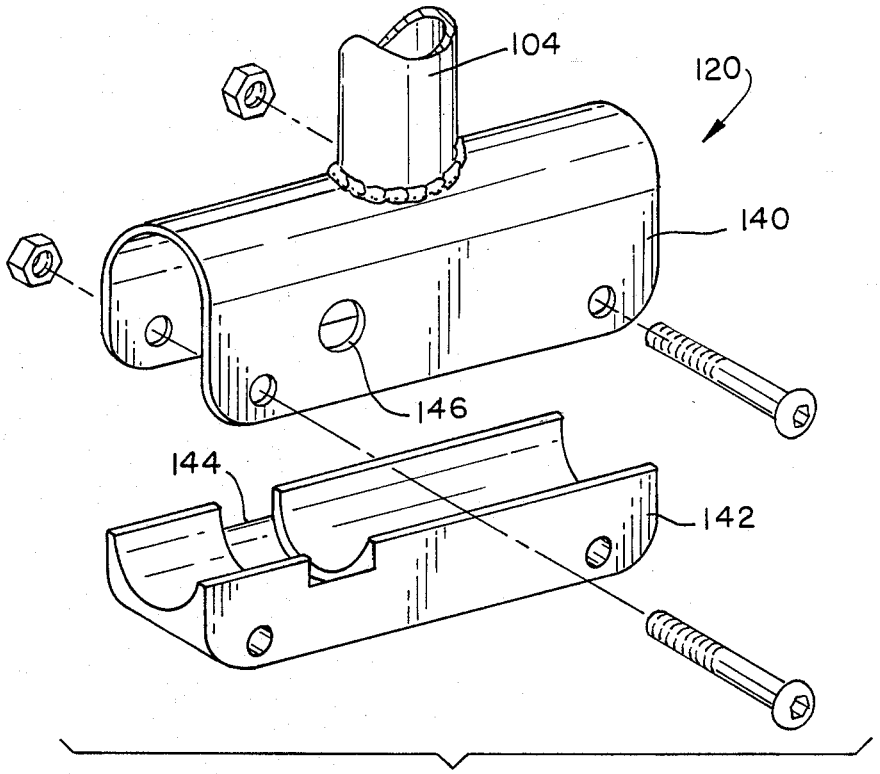
FIG. 7 illustrates an alternate embodiment of the folding mechanism fitting.

With reference to FIG. 7, the fitting 120 may alternately include a U-shaped metal plate 140 which is welding to the lower end of the cross brace member 104. The bottom of the horizontal tubular member receiving passage is defined by an insert 142 which may be of molded plastic or the like. A circumferentially extending groove 144 extends only through the insert 142 and not metal plate 140. When the folding mechanism requires a longer, circumferential groove than is provided by the insert 142, a relief aperture 146 is drilled in the U-shaped plate in alignment with the circumferentially extending groove to receive the projection or a portion thereof at one extreme of motion, e.g. in an opened position.

With reference again to FIG. 1, the seat E includes a lower seat portion 150 of flexible cloth which is anchored by screws 152 or the like to the seat side supports 102. A seat back portion 154 wraps around and is secured to the rear generally vertical side frame tubular members 18 and telescopically received hand grip portions 156.

Figure 8:
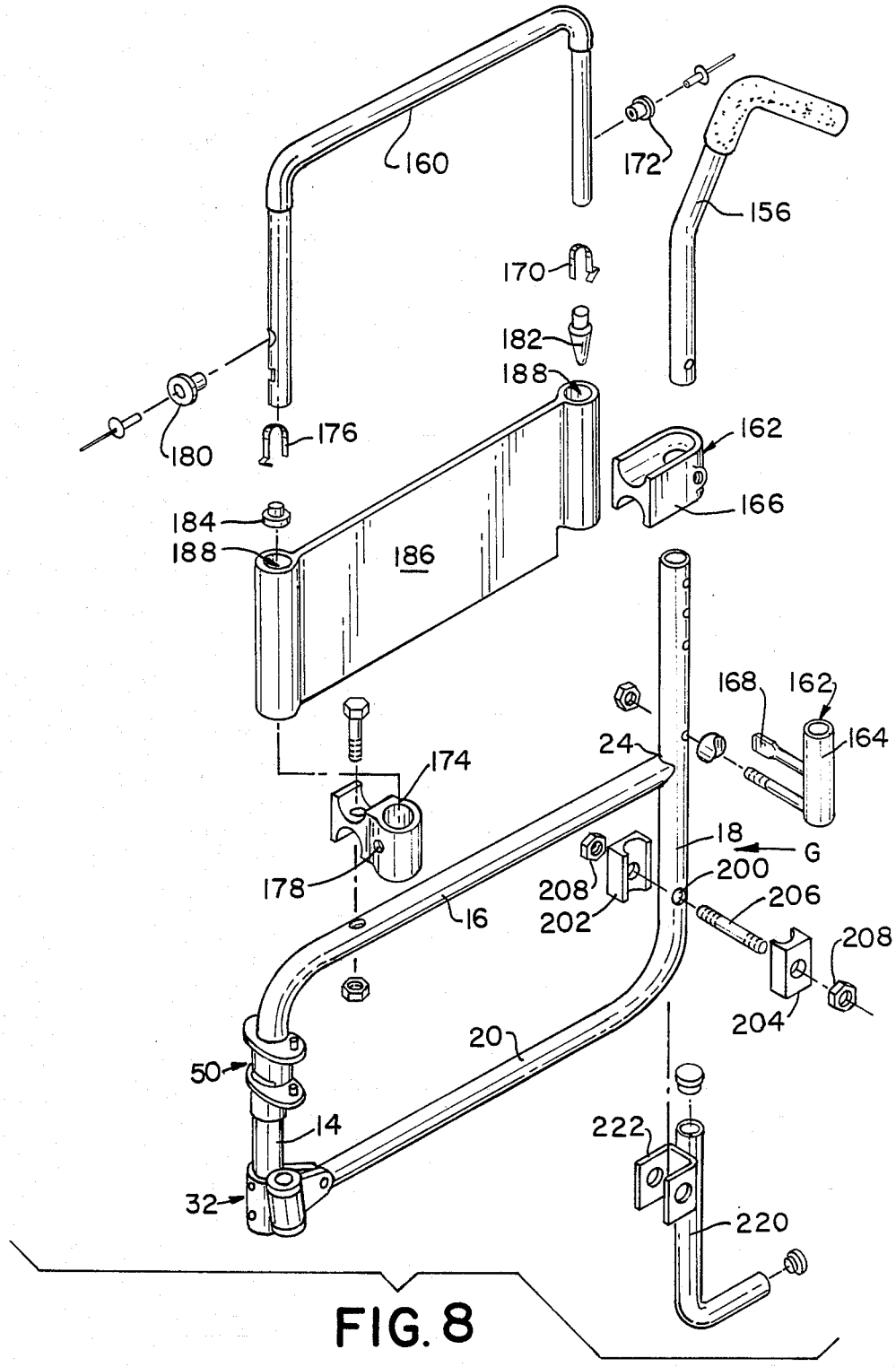
FIG. 8 is an exploded view illustrating the interconnection of a side arm support and shirt guard, a rear wheel mounting assembly, and a curb step mounting assembly; and, FIG. 9 is a side view in partial section illustrating the arm support in its arm supporting position and illustrating a tipped back position in phantom.
Figure 9:
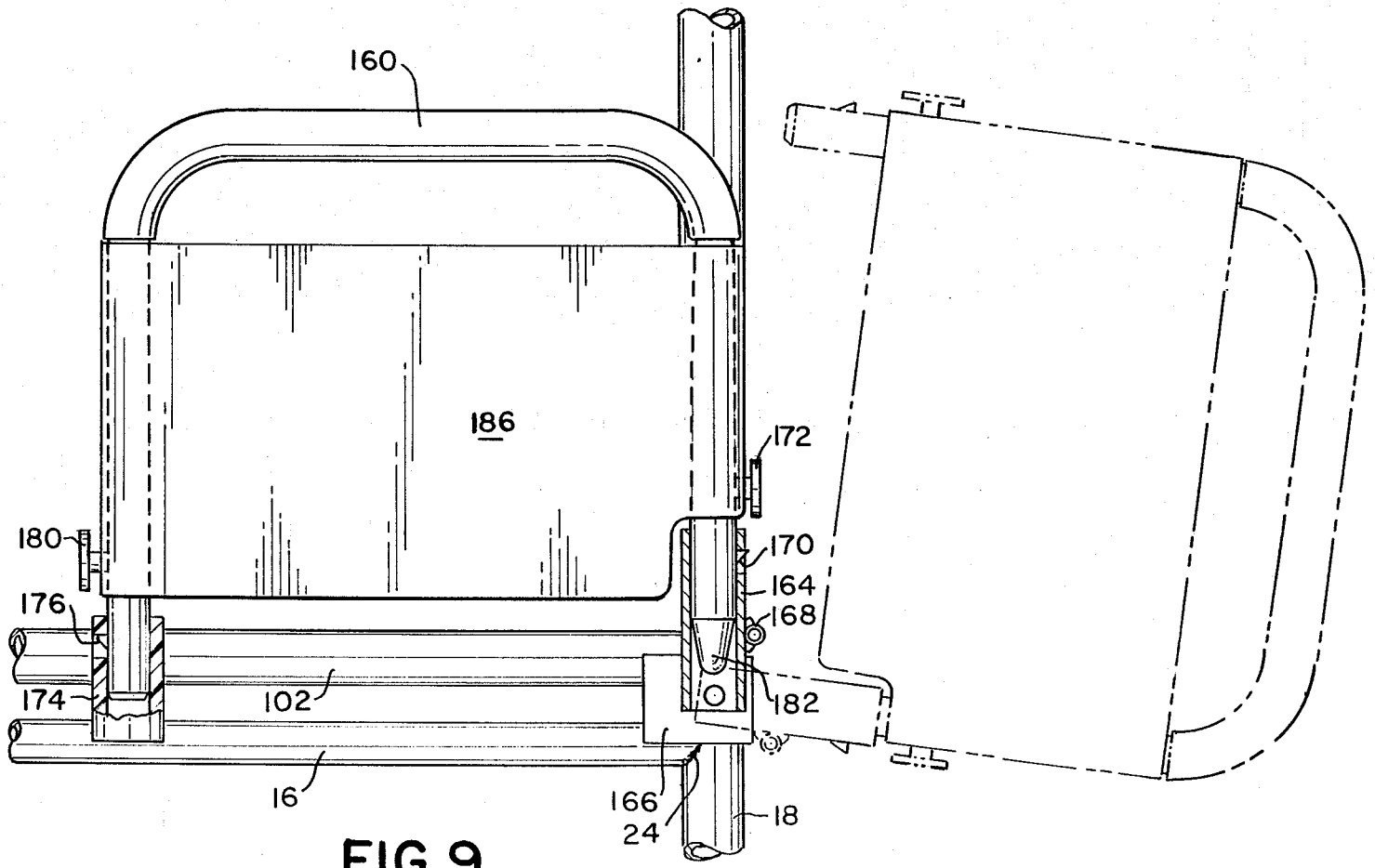

With continuing reference to FIG. 1 and further reference to FIGS. 8 and 9, the arm support structure F includes an arm support member 160 such as a generally U-shaped tube upon which the user's arm may rest. A rearward end of the arm support structure is connected with a first mounting bracket 162 that has a portion 164 which is pivotal relative to the side frames. More specifically, a combined seat side support receiving cradle, weld reinforcing member and first mounting bracket base 166 is connected with the side frame adjacent upper rearward weld 24 to reinforce the weld, support the seat side support 102 when the chair is open, and to have the portion 164 pivotally mounted thereto. A stop 168 limits pivoting movement of the first mounting bracket. A spring detent 170 and release means 172 or other means for releasably securing the arm supporting structure rear end to the first mounting bracket permits the arm support structure to be selectively disconnected therefrom.

A second mounting bracket 174 releasably receives a forward end of the arm supporting structure 160. The second mounting bracket 174 is connected with the upper horizontal side frame tubular portion 16 and defines a seat side support receiving cradle. A second spring detent 176 is spring biased into engagement with an aperture 178 in the second mounting bracket. Upon pressing a release button 180 the spring detent is released from the aperture, allowing the forward end of the arm support structure to be removed from the second bracket. In this manner, the arm support assembly can be removed by pressing both buttons 172 and 180 to release both ends thereof. Alternately, only the front end may be released from the second bracket to allow the arm rest structure to pivot rearward. Preferably, rearward and forward end caps 182, 184, respectively, are configured with a different shape to enable the user to determine which is the front and which is the back of the arm rest structure. A one piece plastic molded shirt guard 186 is molded with passages 186 in either end which are telescopically received over the forward and rearward ends of the generally U-shaped arm supporting structure 160.

With continuing reference to FIGS. 1 and 8, the rear wheel mounting assembly G includes an aperture 200 drilled directly through the rearward vertical tubular portion 18. Because the side frame tubing in the preferred embodiment is relatively light weight, bolting a rear wheel directly in the side frame may cause fatigue and failure. To reinforce the rear frame portion without welding, a pair of reinforcing members 202 and 204 are clamped to either side of the tubing by a threaded tubular member 206 and associated nuts 208. The tubular member 206 extends through the mounting members and the generally vertical rearward tubular side frame portion 18. By clamping the reinforcing members adjacent the side frame aperture, significant additional strength is imparted thereto. An axle mounting shaft or bolt 210 extends into the threaded tubular member 206 to provide an axle for mounting a rear wheel 212 thereon.

A curb step member 220 includes a generally U-shaped mounting bracket 222 which fits securely around the reinforcing members 202, 204. By clamping the U-shaped mounting member 222 to the reinforcing members, additional strength is achieved.

The invention has been described with particular reference to the preferred embodiments. Obviously, alterations and modifications will occur to others of ordinary skill in the art upon reading and understanding the preceding detailed description. It is intended that the invention be construed as including all such alterations and modifications insofar as they come within the scope of the appended claims or the equivalents thereof.

Having thus described a preferred embodiment, the invention is now claimed to be:

1. A wheelchair comprising:

left and right side frames, each side frame including upper and lower generally horizontal legs and generally vertical forward and rearward legs connected with the general horizontal legs;

a pair of rear wheels mounted to the side frames;

a pair of front wheel assemblies mounted to the side frames;

a seat portion operatively connected with the side frames;

a pair of seat side supports which are connected with side portions of the seat;

a pair of cross members, each cross member fixedly connected at an upper end to one of the side supports;

a pair of fittings, each fitting being fixedly connected with a lower end of one of the cross members and defining a side frame tubing section receiving aperture therein, each of the fittings receiving the generally horizontally disposed lower leg of one of the side frames therein for rotating movement thereon; and, a projection and circumferentially extending guide slot arrangement interconnected with at least one of the fittings and the horizontal leg received therein for maintaining the fitting and the side frame in alignment.

2. A wheelchair comprising:

left and right side frames, each side frame including at least a generally horizontal and a generally vertical forward leg connected by a weld;

a pair of rear wheels mounted to the side frames;

a pair of front wheel assemblies mounted to the side frames;

a seat portion operatively connected with the side frames;

a pair of reinforcing tubes, each reinforcing tube being slidably disposed in one of the side frame generally vertical forward legs;

a pair of front wheel mounting assemblies, each front wheel mounting assembly having a mounting bracket which partially surrounds and reinforces the weld; and, a plurality of mechanical fasteners extending through each wheel assembly mounting bracket, tubular reinforcing tube and generally vertical forward leg.

3. The apparatus as set forth in claim 2 further including a pair of front leg rest mounting members for selectively receiving front leg rests thereon, the front leg rests mounting members each being attached by mechanical fasteners to one of the generally vertical forward legs and the reinforcing tube slidably received thereon.

4. A wheelchair comprising:

(a) a pair of side frames, each side frame having a generally vertical forward tubular portion and a generally horizontal portion connected thereto;

(b) a pair of reinforcing tubes each slidably received in one of the forward tubular portions;

(c) a pair of front wheel assemblies, each front wheel assembly including a generally U-shaped bracket which extends around the connection between the forward tubular portion and the generally horizontal portion;

(d) a plurality of mechanical fasteners extending through the wheel assembly mounting brackets, the forward tubular portions, and the reinforcing tubes to mount each front wheel assembly to one of the side frames; and, (e) a pair of rear wheels operatively connected to the side frames.

5. The wheelchair as set forth in claim 4 further including:

an arm rest assembly which is removably received in forward and rearward arm support structure mounting brackets operatively connected with the side frame, such that the arm support member is removable therefrom; and, a pivot means operatively associated with one of the arm support mounting brackets for permitting the arm support member to pivot relative to the side frames when one end is released from the other mounting bracket.

6. The wheelchair as set forth in claim 4 further including a folding means for interconnecting the pair of side frames for selectively moving the side frames together to a compact configuration to facilitate storage and handling and for selectively moving the side frames apart to an unfolded configuration which readily receives a user seated therebetween.

7. A foldable wheelchair comprising:

(a) first and second side frames, each side frame including at least a lower, generally horizontally disposed tubular side frame potion;

(b) a plurality of wheels operatively connected with the side frames;

(c) a seat including first and second generally horizontally disposed side supports and a flexible support surface extending therebetween, the first and second side supports being disposed generally above and parallel to the first and second side frames, respectively;

(d) a first cross brace member connected at an upper end with the first side support and at a lower end with a first fitting which defines a circular passage therethrough, the first fitting rotatably receiving the second side frame lower horizontal tubular portion therein;

(e) a second cross brace member connected at an upper end with the second side support and at a lower end with a second fitting which defines a circular passage therethrough, the second fitting rotatably receiving the first side frame lower horizontal tubular portion therein;

(f) the fittings each defining a circumferentially extending guide slot which receives an engaging projection mounted on the corresponding side frame lower horizontal tubular porton.

8. The wheelchair as set forth in claim 7 wherein the first and second side frames include first and second upper, generally horizontal tubular side frame portions, respectively, and further including:

first and second guide links which are pivotally connected at one end with the first and second cross brace members, respectively, and which rotatably receives the first and second upper horizontal side frame tubular portions, respectively therethrough; and, slot and projection means operatively connected with the second fittings and the upper generally horizontally tubular frame portions for maintaining alignment.

9. A wheelchair comprising:

(a) first and second side frames, each side frame including a lower generally horizontal member and an upper generally horizontal member;

(b) first and second identical seat support structures, each structure including:

(i) a seat side support, (ii) a cross member fixedly connected at an upper end to the side support, (iii) a fitting fixedly connected with a lower end of the cross member, the fitting defining a transverse passage therethrough for rotatably receiving one of the side frame lower horizontal members, the fitting defining a groove extending circumferentially along its passage to receive a projection attached to the received one of the side frame lower horizontal members, the circumferential groove being disposed rearwardly of the member;

(c) means for pivotally connecting the cross members, the pivotally connected cross members being connected to the side frames such that the first seat side support is disposed above and generally parallel to the first side frame upper horizontal member, the second side seat support is disposed above and generally parallel to the second side frame upper horizontal member, the first fitting rotatably receives the second side frame lower horizontal member, and the second fitting rotatably receives the first side frame lower horizontal member;

(d) first and second identical link members, each link member being pivotally connected at one end with one of the cross members and having a link fitting at another end for rotatably receiving one of the side frame upper horizontal member;

(e) a foldable supporting surface connected to the seat side supports; and (f) a plurality of wheels operatively connected with the side frames.

10. A wheelchair comprising:

a pair of side frames, each side frame having a forward, generally vertical tubular portion which is relatively deformable;

a pair of reinforcing tubes each slidably received in one of the forward tubular portions to reduce the deformability thereof;

a pair of front leg rests, each connected to an upper portion of one of the forward tubular portions and cantilevered forward therefrom such that force on the leg rests tends to deform the forward tubular portion;

a mechanical fastening means for connecting each front leg rest through one of the forward tubular portions to one of the reinforcing tubes such that the reinforcing tube resists deformation of the forward tubular portion due to pressure on the cantilevered front leg rests; and, a plurality of wheel assemblies operatively connected to the side frames.

11. The wheelchair as set forth in claim 10 further including a pair of front leg rest mounting brackets which selectively mount a movable, swing away leg rest thereon, each leg rest mounting bracket being attached to one of the side frame generally vertical forward tubular portions and its slidably received reinforcing tube with mechanical fastening means.

12. A wheelchair comprising:

(a) a pair of side frame portions;

(b) a pair of rear wheels, each rear wheel mounted to one of the side frame portions;

(c) a pair of front wheel assemblies, each operatively connected to one of the side frames;

(d) a pair of selectively removable, swing away arm rest assemblies, each arm rest assembly including:

(i) a mounting means bracket having a stationary portion connected to one of the side frames and a pivotal portion pivotally connected to the stationary portion, for pivotal movement about a generally horizontal axis, (ii) an arm support portion having a first end releasably supported by the first mounting bracket means pivotal portion, such that the arm support portion pivots with the pivotal portion about the horizontal axis and releasing the first end from the pivotal portion enables the arm support portion to be removed.

13. The wheelchair as set forth in claim 12 wherein the side frame portions each include upper and lower horizontal members and generally vertical forward and rearward members connected with the upper and lower horizontal members, the mounting means bracket stationary portion being connected with the one side frame adjacent an interconnection between the upper horizontal member and the vertical rearward member.

14. A foldable wheelchair comprising:

(a) first and second side frames, each side frame including a lower generally horizontal member and an upper generally horizontal member;

(b) first and second identical seat support structures, each structure including:

(i) a seat side support, (ii) a cross member fixedly connected at an upper end to the side support, (iii) a fitting fixedly connected with a lower end of the cross member, the fitting being rotatably mounted with one of the side frame lower horizontal members therein;

(c) means for pivotally connecting the cross members, the pivotally connected cross members being connected to the side frames such that the first seat side support is disposed above and generally parallel to the first side frame upper horizontal member;

(d) first and second identical link members, each link member being pivotally connected at one end with one of the cross members and having a link fitting at another end for rotatably receiving one of the side frame upper horizontal members, the link fitting including a projection and circumferential extending guide slot arrangement interconnected with the link member and upper horizontal member for maintaining the link member and side frame in alignment;

(e) a foldable supporting surface connected to the seat side supports; and, (f) a plurality of wheels operatively connected with the side frames.

15. The wheelchair as set forth in claim 14 further including a bracket mounted to the upper generally horizontal member, the bracket having a recess for receiving and positioning the side support relative thereto.

16. The wheelchair as set forth in claim 15 further including an arm support means connected with said bracket.

* * * * *